United States Patent [19]

Pocholle

[11] 4,173,953

[45] Nov. 13, 1979

[54] FUEL INJECTION PULSE SUPPRESSOR APPARATUS

[75] Inventor: Bernard Pocholle, Paris, France

[73] Assignee: Robert Bosch GmbH, Stuttgart, Fed. Rep. of Germany

[21] Appl. No.: 874,291

[22] Filed: Feb. 1, 1978

[30] Foreign Application Priority Data

Feb. 2, 1977 [DE] Fed. Rep. of Germany ..... 2704180

[51] Int. Cl.[2] ..... F02B 3/00

[52] U.S. Cl. ..... 123/32 EL; 123/32 EA

[58] Field of Search ..... 123/32 EL, 32 EA, 97 B, 123/198 D, 198 DB

[56] References Cited

U.S. PATENT DOCUMENTS

| | | | |
|---|---|---|---|
| 3,463,130 | 8/1969 | Reichardt et al. | 123/32 EL |
| 3,703,162 | 11/1972 | Aono | 123/32 EL |
| 3,736,910 | 6/1973 | Raff | 123/32 EA |
| 3,866,584 | 2/1975 | Bigalke et al. | 123/32 EL |
| 4,094,274 | 6/1978 | Harada et al. | 123/32 EL |

*Primary Examiner*—Charles J. Myhre

*Assistant Examiner*—P. S. Lall

*Attorney, Agent, or Firm*—Edwin E. Greigg

[57] ABSTRACT

A circuit for use in conjunction with the fuel injection controller of an internal combustion engine in which fuel injection valve control pulses are generated on the basis of engine information, for example, engine speed and air flow rate. When the engine is being operated at negative torque (downhill operation, engine braking) the valve control pulses are suppressed. This condition is detected by comparing the length of preliminary control pulses with a reference pulse generated by a monostable multivibrator which is triggered by pulses synchronous with engine speed. A first comparator circuit sets a bistable multivibrator when the preliminary pulses are shorter than the reference pulse and a second comparator circuit resets the bistable multivibrator in the opposite case. The bistable multivibrator controls an output elemet which can suppress the valve control pulses in one of the two states. A hysteresis-inducing feedback path is provided so that pulse suppression occurs at a slightly different pulse length than does pulse transmission in order to prevent oscillations.

4 Claims, 2 Drawing Figures

FUEL INJECTION PULSE SUPPRESSOR APPARATUS

BACKGROUND OF THE INVENTION

The invention relates to fuel management of internal combustion engines. More particularly, the invention relates to an apparatus to be used in association with a fuel injection system for internal combustion engines. The fuel injection system with which this apparatus is associated is one that employs electromagnetic fuel injection valves that are actuated by electrical control pulses which are generated on the basis of the sensed magnitude of engine variables, for example the air flow rate and engine speed. In known fuel injection systems of this type, the fuel control pulses are entirely suppressed and fuel supply is entirely interrupted whenever the throttle valve of the engine is completely closed while the engine is maintaining a speed above a certain minimum. This combination of conditions indicates so-called overrunning or downhill operation (negative engine torque). The known mechanisms for terminating fuel delivery by suppressing the control pulses include sensors for detecting the position of the throttle valve as well as further sensors for detecting engine speed. In addition, the known pulse suppressor systems require engine temperature information so as to set the points at which the control pulses are suppressed and readmitted. These various sensors increase the cost of the known apparatus and increase its space requirement as well as diminishing its reliability.

OBJECT AND SUMMARY OF THE INVENTION

It is thus a principal object of the invention to provide an apparatus to be used in association with an intermittent fuel injection control system and which is capable of suppressing fuel delivery during engine overrunning. It is a further object of the invention to provide fuel control pulse suppression with relatively simple means and thereby with greater reliability. These and other objects are attained according to the invention by providing a control pulse suppressor circuit including only three active switching elements, for example transistors, in addition to a bistable flip-flop. External sensors are not required because the signals used by the circuit according to the invention are those which are normally already present in the known fuel injection systems. It is a further advantage of the invention that when the engine is cold and the fuel suppression must be shifted to a higher rpm, such correction takes place automatically due to the construction of the circuit of the invention.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
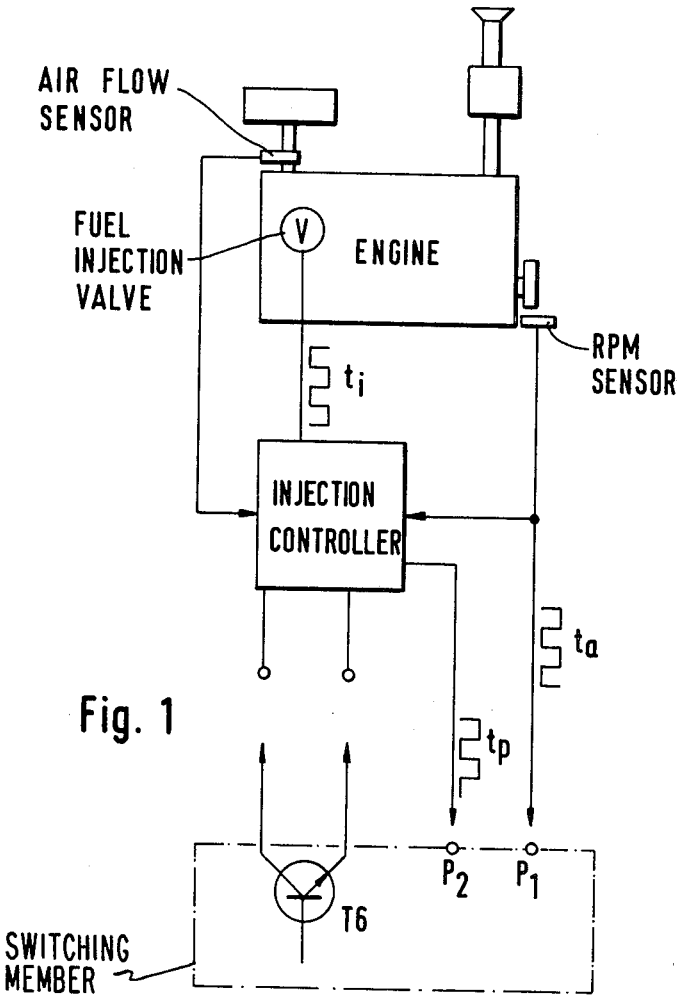
FIG. 1 shows the connection of the apparatus according to the invention with the engine and its fuel injection system.
Figure 2:
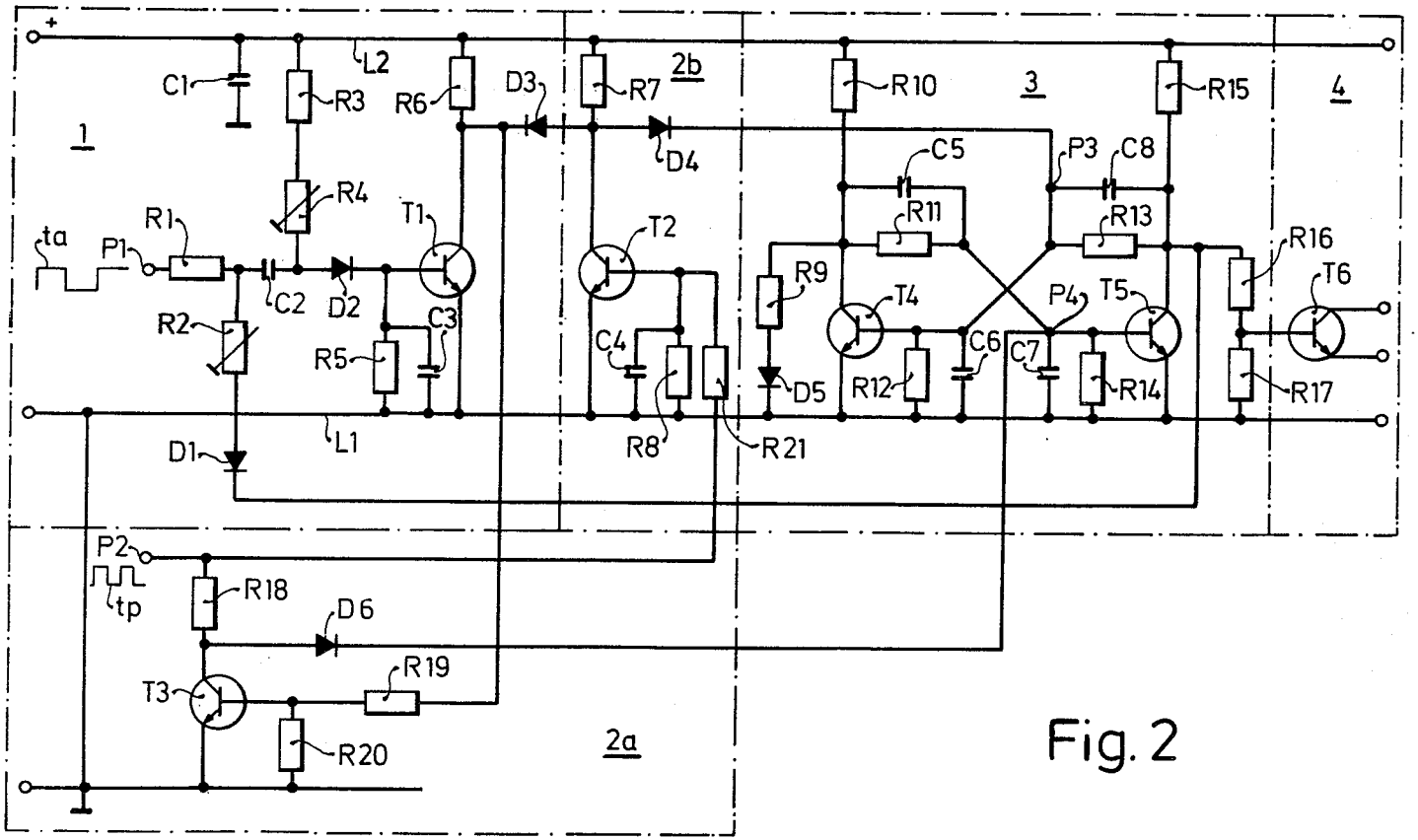
FIG. 2 of the drawing is a detailed circuit diagram of the apparatus according to the invention.

Turning now to the circuit diagram illustrated, there will be seen dash-dotted demarcation lines defining different and substantially independent portions of the circuit. In particular, there is provided a monostable multivibrator 1 which generates a settable reference time $t_r$. A preliminary pulse $t_p$ which is generated routinely by the known fuel injection system with which the present invention is associated is compared in duration with the time $t_r$. The preliminary pulse $t_p$ is generated in a computing circuit on the basis of direct proportionality to the air flow rate and reverse proportionality to engine speed and in known manner. The fuel injection system normally includes circuitry for modifying the preliminary pulse on the basis of various engine variables and conditions as well as on the basis of the battery supply voltage. The preliminary pulses $t_p$ already present in the known fuel injection system are used by the circuit of the present invention as an input pulse train. An additional input pulse train $t_a$, to be referred to below as a triggering pulse train, is a square wave pulse which is proportional to crankshaft rotation. For this reason, the half-wave of the rectangular pulse train $t_a$ is always longer than any possible duration of the preliminary pulse $t_p$. The circuit according to the invention further includes two comparator circuits 2a and 2b which process the output signal from the monostable multivibrator 1 and the pulse train $t_p$. The circuit then further includes a data storage circuit in the form of a bistable flip-flop 3 whose inputs are triggered by the outputs of the comparator circuits 2a and 2b and which may therefore be placed into one of two possible switching states. The bistable flip-flop 3 acts on a switching member 4, that acts directly for example on the base of an output transistor in the fuel injection system in the manner of suppressing the generation or delivery of fuel injection control pulses when the transistor T6 conducts and thereby to cause the termination of fuel delivery.

The monostable multivibrator 1 consists substantially of a single active element, i.e. a transistor T1, whose emitter is grounded or connected to the more negative supply line L1 while its collector is connected via a resistor R6 to the positive supply line L2. The base of the transistor T1 is connected through a capacitor C2 and a diode D2 to receive the aforementioned triggering pulse train $t_a$ at a circuit point P1 via an input resistor R1. The junction of the capacitor C2 and the diode D2 is connected via an adjustable voltage divider consisting of resistors R3 and R4 to the positive supply line L2. A base drain resistor R5 is provided with a parallel capacitor C3.

In the normal case, i.e. when no signal is applied to the transistor T1, it will be in the conducting state because it receives base current via the resistors R3 and R4 and the diode D2. The negative-going edge of the triggering pulse train $t_a$ causes this multivibrator to enter its blocking state for a time $t_r$ which is adjustable because of the presence of the resistor R4. However, as is always the case in so-called economy monostable multivibrators of this type, the unstable state $t_r$ must always be shorter than the half period of the triggering pulse train $t_a$. The time $t_r$ in which the transistor T1 resides in the unstable state is a reference time which represents the shortest permitted duration of the fuel injection control pulses. Whenever the injection control pulses $t_p$ are shorter than $t_r$ the circuit according to the invention will act to suppress the fuel valve actuation pulses. Whenever the duration of the preliminary pulses $t_p$ again becomes greater than the reference time $t_r$, the circuit according to the invention acts to again permit the provision of fuel injection control pulses to the injection valves of the engine. It is a particular feature of the invention that circuit elements are provided for reinitiating the admission of fuel injection pulses only when the duration of $t_p$ of the preliminary pulses is actually greater than the reference time $t_r$ by a predetermined constant amount $t_k$ which represents hysteresis behavior and will be discussed in more detail below.

In order to carry out the comparison between the pulse length $t_p$ and the reference time $t_r$, there are provided two essentially similar comparator circuits 2a and 2b including, respectively, transistors T3 and T2. The emitter of the transistor T2 is connected to the negative line L1 and its base receives the preliminary pulse $t_p$ from the circuit point P2 via the resistor R21 and is thereby rendered conducting. The collector of the transistor T2 is connected via a resistor R7 to the positive line L2 and it is further connected via a diode D3 with the collector of the transistor T1. Another diode D4 connects it to a triggering or set input P3 belonging to the subsequent bistable flip-flop 3. The comparison circuit 2b includes a base drain resistor R8 connected in parallel with a capacitor C4. During the occurrence of a pulse in the preliminary pulse train $t_p$, the transistor T2 conducts so that its collector lies at substantially ground potential, causing the diode D4 to block and preventing any transmission of a set pulse to the subsequent flip-flop 3. However, if the duration of the preliminary pulse $t_p$ happens to be shorter than the unstable time constant of the monostable multivibrator 1, then the transistor T2 will have returned into its non-conducting state before the expiration of the time $t_r$ when the transistor T1 becomes conducting and could prevent the passage of a positive pulse from the collector of the transistor T2 through the diode D4 to the bistable flip-flop 3. When the transistor T1 conducts, i.e. during the normal state of the monostable multivibrator, the collector of the transistor T2 is pulled to a voltage lying above ground potential only by the conduction voltage drop of the diode D3 and the saturation voltage of the transistor T1.

When the pulse length $t_p$ is less than the pulse length $t_r$, a positive pulse can reach the point P3 of the bistable flip-flop 3, causing the transistor T4 to conduct and the transistor T5 to block. The bistable flip-flop is of per se known construction and includes the usual crossed feedback paths which are in this case embodied as resistors R11, R13 and their parallel capacitors C5 and C8 and includes as main switching components the transistors T4 and T5 whose emitters are directly grounded to the line L1 and whose collectors are connected to the positive line via respective resistors R10 and R15. When the transistor T5 blocks, the base of the subsequent switching transistor T6 receives base current via resistors R15 and R16 causing the transistor T6 to conduct and, as has been stated, a conducting transistor T6 shall be assumed to be used for suppressing the delivery of fuel injection control pulses in any suitable manner, thereby inhibiting the delivery of fuel to the engine.

In every other possible case, the transistor T1 in the economy multivibrator 1 conducts and prevents the delivery of any positive pulse through the diode D4 to the set input of the bistable flip-flop 3.

In the opposite possible case, i.e. when the preliminary pulses $t_p$ are longer than the reference time $t_r$, it is intended to release the generation or delivery of fuel injection control pulses and for this purpose there is provided the second comparator circuit 2a including a transistor T3. The construction and function of the circuit 2a is substantially similar to that of the comparator circuit 2b except that, here the base of the transistor T3 receives the pulse from the collector of the transistor T1, the duration of which is the reference time $t_r$, while the collector of the transistor T3 receives the preliminary pulse train $t_p$. In this way, the function of the comparator circuit 2a is complementary to that of the comparator circuit 2b, i.e. the transistor T3 blocks whenever the reference time $t_r$ is shorter than the duration of the preliminary control pulse $t_p$ present at its collector. In that case, a triggering pulse passes from the collector of the transistor T3 via the conducting diode D6 to the base of the second transistor T5 in the flip-flop 3 at the circuit point P4, rendering the transistor T5 conducting and causing the blockage of the output transistor T6.

In order to prevent oscillations in the circuit of the invention, the comparator circuit 2a is made to reset the flip-flop 3 only when the preliminary control pulses $t_p$ are actually somewhat longer than the reference time $t_r$ by an amount $t_k$. This hysteresis action is provided by connecting a feedback branch consisting of the series connection of the diode D1 and an adjustable resistor R2 from the collector of the transistor T5 back to the base circuit of the transistor T1 at the junction of the input resistor R1 and the capacitor C2. Therefore, the engine speed at which fuel suppression occurs will always be somewhat higher than that at which fuel delivery is reinstituted. The effect of the feedback branch just described is based on the fact that, when the transistor T5 conducts during normal operation and normal fuel delivery, the then conducting diode D1 increases the effect of the negative voltage on the base circuit of the transistor T1 so that the amount of charge reaching the base of the transistor when it is being triggered is greater. For this reason, the reference time $t_r+t_k$ is also greater.

It should be noted that the circuit according to the invention makes an automatic compensation for the requirement that the engine speed "n" at which fuel suppression occurs should be increased when the engine is cold. This is so because for that condition a known supplementary air valve admits more air to the engine, thereby increasing the duration of the preliminary fuel control pulses $t_p$ and raising the effective engine speed at which fuel control pulse suppression occurs.

The foregoing relates to a preferred exemplary embodiment of the invention, it being understood that other embodiments and variants thereof are possible within the spirit and scope of the invention.

What is claimed and desired to be secured by Letters Patent of the United States is:

1. An apparatus for suppressing fuel injection control pulses, said control pulses serving to actuate fuel injection valves of an internal combustion engine, said control pulses being generated at least as a function of engine speed and air flow rate into the engine, and said apparatus including:

a reference circuit for generating reference pulses having a definite length termed reference length;

a first comparison circuit for comparing said control pulses with said reference pulses and for generating a first signal when said control pulses are shorter than said reference pulses;

a second comparison circuit for comparing said control pulses with said reference pulses and for generating a second signal when said control pulses are longer than said reference pulses;

a bistable multivibrator triggered by said first and second signals, respectively, to thereby be placed into one of two states; and an output circuit, actuated by said bistable multivibrator, for suppressing said fuel injection control pulses during one state of said bistable multivibrator and wherein the improvement comprises:

said reference circuit is a monostable multivibrator having a single transistor, and each of said first and second comparator circuits includes a switching transistor, connected to the transistor in said reference circuit, the base of one of the switching transistors being connected to the collector of said single transistor, while the collector of the other switching transistor is connected to the collector of said single transistor and its base is connected to receive said control pulses;

and wherein the collectors of said switching transistors are connected to the inputs of said bistable multivibrator and determine its status.

2. An apparatus as defined by claim 1, wherein the base of said single transistor is connected through a capacitor and via adjustable charging resistors to the voltage supply line of the circuit and wherein the collector of said single transistor is connected via a diode (D3) to the collector of said switching transistor (T2) in said first comparator circuit (**2*b*) and wherein the base of said transistor (T2) is connected to receive said control pulses, the collector of said single transistor (T1) in said reference circuit being connected to the base of said second switching transistor (T3) in said second comparator circuit (2*a*), and the collector of said transistor (T3**) receiving said control pulses.

3. An apparatus as defined by claim 2, wherein said bistable multivibrator has at least two set inputs for being placed in one or the other of its two possible states, and wherein the collectors of said switching transistors (T2, T3) are connected via respective diodes (D4, D6) to said set inputs of said bistable multivibrator; whereby, when said control pulses are shorter than said reference pulses, said bistable multivibrator occupies the status in which said fuel control pulses are suppressed.

4. An apparatus as defined by claim 1, wherein said bistable multivibrator includes at least two switching transistors and wherein the collector of that transistor (T5) in said bistable multivibrator which blocks when said fuel control pulses are being suppressed is connected via a diode and a resistor to the base of said single transistor (T1) in said reference circuit; whereby said bistable multivibrator is not reset until the length of said control pulses is greater by a finite and adjustable amount than the length of said reference pulses.

* * * * *